US005193697A

United States Patent [19]

Lubczyk et al.

[11] Patent Number: 5,193,697

[45] Date of Patent: Mar. 16, 1993

[54] RAIL ELEMENT FOR THE RECEPTION OF ARTICLE SUPPORTS

[75] Inventors: Reinhold Lubczyk, Bördel; Andreas Kranz, Göttingen, both of Fed. Rep. of Germany

[73] Assignee: Heinz Peter Adams, Gottingen, Fed. Rep. of Germany

[21] Appl. No.: 735,804

[22] Filed: Jul. 25, 1991

[30] Foreign Application Priority Data

Jul. 26, 1990 [DE] Fed. Rep. of Germany ..... 4023685

[51] Int. Cl.[5] ..... A47F 5/00

[52] U.S. Cl. ..... 211/183; 211/190; 211/208

[58] Field of Search ..... 211/183, 190, 208

[56] References Cited

U.S. PATENT DOCUMENTS 2,995,257 8/1961 D'Anka ..... 211/208
4,444,323 4/1984 Travis ..... 211/208 X
4,585,130 4/1986 Brennan ..... 211/190
4,712,696 12/1987 Klein ..... 211/183 X

FOREIGN PATENT DOCUMENTS 1047427 11/1966 United Kingdom ..... 211/190

*Primary Examiner*—Robert W. Gibson, Jr.
*Attorney, Agent, or Firm*—Hopkins & Thomas

[57] ABSTRACT

A rail element for the reception of article supports with a metallic profile strip (20) having a cross section with at least two legs (2, 3) defining a right angle (4), having openings (5) in one of the legs (2) for the reception of hook-formed brackets of article supports. The openings are provided in an aligned manner at a mutual distance in the main direction of extension of the rail element according to a modular dimension which allows a height-adjustable arrangement of the article supports. In the other leg (3) openings (6) are provided as well and arranged at the same height as the openings (5) in the first leg (2). Both facing openings (5, 6) are connected with a clearance (7, 8) forming a continuous recess which extends over the right angle (4).

13 Claims, 9 Drawing Sheets

RAIL ELEMENT FOR THE RECEPTION OF ARTICLE SUPPORTS

BACKGROUND OF THE INVENTION

The invention relates to a rail element for the reception of article supports, with a metallic profile strip having a cross section with at least two legs defining a right angle, one of the legs having openings for inserting hook-formed brackets of article supports which are provided at a mutual distance in the main direction of extension of the rail element in an aligned manner according to a modular dimension allowing a height-adjustable arrangement of the article support. Such rail elements or rail sections serve the purpose of accommodating article supports equipped with brackets, having surfaces or the like for storing or hanging etc. articles on them. This kind of rail element enables the construction of stands, shelfs and similar constructions which are suitable for the reception and presentation of articles.

A rail element in the form of a profile strip of the said kind is known from DE-GM 88 02 770. The profile strip consists of a folded metallic strip and has a web and two legs protruding from it thus forming as a whole a U-shaped cross section. The web contains openings in the form of slots which essentially follow a vertical direction, i.e. along the main direction of extension of the profile strip, having a substantially greater extension in this direction than across it. These slot-formed openings are arranged at a certain modular dimension enabling the bracketed article supports to be inserted at height-adjustable steps. Furthermore, the web contains piercings through which anchoring bolts can be screwed into dowel holes which are located in the wall. The known rail element is formed and determined solely for anchoring to a wall or any other vertical surface. It is aligned in such a way that the two free ends of the legs are adjacent to the wall.

This way, a hollow space is enclosed in the rail element into which hook-formed ends of a bracketed article support may be inserted. Usually the bracket-like article support is formed in such a way that at each inserting spot two hook-formed catches grip into two adjacent openings and interlock in them. It is obvious that in this construction two rail elements or two profile strips must be aligned at a corresponding distance vertically to each other on a wall in order for, e.g. article supports, to be inserted into both rail elements so that the placing surface extends in a horizontal manner. As can be seen, these rails and article supports enable a shelf-like wall construction suitable to hold e.g. books. The profile strip, which essentially forms the rail element, has been kept small in dimension, i.e. the web and the two legs are of a small width as determined by the slot-like opening and the room required for interlocking. Given that the bracket-like article supports have a plate thickness of 1 mm or 3 mm at the most at the inserting part, the width of the slot-like opening is only of a size big enough for one or—if required—two bracket-like article supports to be inserted into this opening. Furthermore, the known rail element is not very appealing in terms of decoration but is kept as small and unconspicuous as possible. Because its application is confined solely to a wall fixture which may take place on both sides, center room stands or other freely standing units cannot be constructed with it.

In order to correct this disadvantage, but also for aesthetic reasons, it is already known to connect slotted rail elements consisting of only one web with slot-formed openings with two columns in such a way as to create a portative unit. The columns may be formed by wooden or metallic profile strips requiring an anchoring between the columns and the slotted rail which is usually included. This enables for shelfs and other stand units to be created which are moved off the wall or erected in the space, the bracketed article support being insertable into the slotted rail again. Such an application is however comparatively demanding, because besides the slotted rails the columns supplying the sturdiness must be produced separately and the parts have to be connected. It is precisely this connection which in some cases gives rise to difficulties, at least however, to additional work to be carried out. In many cases welded or screwed connections cannot be accepted for decorative reasons.

SUMMARY OF THE INVENTION

It is the object of the present invention to create a rail element of the above-mentioned kind departing from which it is possible to insert brackets which protrude into several spacial directions, also in case of tight fitting conditions.

In accordance with the invention this is achieved by providing openings in the other leg as well which are arranged at the same height as the openings in the first leg, both openings allocated to each other being connected by a clearance forming a continuous recess extending over the right angle.

Therefore, openings are provided in both of the legs which define a right angle, connected by a clearance which extends over the corner or edge of the profile strip forming as a whole a large-spaced angular recess. This angular recess provides not only the possibility of allocating brackets in the two spacial directions vertical to the surface plane of the legs in a projecting manner, but at the same time the possibility of inserting the hook-like brackets across to their main direction of extension at the rail element. In the state of the art the inserting of the hook-like brackets takes place in the main direction of extension of the brackets and hence vertical to the wall of the rail element into which the bracket is to be inserted, while here it takes place spun around by 90°. This creates possible variations unknown until now in the state of the art which are useful in particular when the rail elements are arranged facing each other. This may be the case e.g. when article supports are to be placed between gallery walls. The rail elements may be placed at the face or the side of the gallery wall. Further the possibility is given to continue to erect, i.e. to arrange several article supports in one straight line next to each other. This also enables even for angular aligned article supports to be inserted, i.e. article supports whose ends of their brackets are at a 90° angle to each other. Room elements, if in a free-standing arrangement, can be created with the rail element or equipped with it this way.

The joint contours of an opening and of the pertaining part of the clearance in one of the legs can be greater than the contours of the inserted part of the hook-formed bracket in order for the article support to be easy to fit with translatory moves. Here inserting does not require for the article support to be tilted.

The opening including the corresponding part of the clearance can be arranged on a leg by forming connecting bridges extending between the openings and a wall part extending in the plane of the leg. This way a great portion of the profile strip at this part is breached, the continuous recess reaching around the corner. A small part of the plane, i.e. the wall part, is provided on one side in an asymmetric arrangement and connecting bridges being provided between the recesses which are arranged at the distance of the modular dimension. This way height-adjusting function is achieved but also an appealing aesthetic impression deviating from the arrangements known until now.

The ratio of the edge length of the opening including the part of the clearance in a leg vertical to the main direction of extension to the height of the connecting bridges located between the openings to the width of the wall parts can be approx. 3:2:1. This ensures sufficient stability, even though, the continuous recess has been designed comparatively large.

Essentially, the rail element shows only one angular cross section from the two legs, in a special embodiment it is possible for the rail element to have a tubular, squared cross section, the openings and clearances being arranged in three legs creating a continuous open space extending over three legs. This creates an even larger continuous recess which holds a streamlined appearance besides its technical functions. If desired, it can be closed with shutters. Further, it is possible to insert rod-like material into these kinds of openings in that supports are formed.

On the two legs defining a right angle, angular sections may be annexed for forming an internal or external corner which define a plane which is set back compared to the surface of the corresponding leg and the measurement of the backsetting is harmonized to the thickness of a surface-finished board. Hence, such rail elements can be applied in connection with veneer plywood which is surface-coated or planked in some way, and the cutting surfaces of the plywood do not have to be specially treated. They disappear when the rail elements are applied and the external and internal corners are formed. Here too however the article supports are intercalated and inserted from the side.

BRIEF DESCRIPTION OF THE DRAWINGS

The supplied drawings represent advantageous embodiments of the rail elements and are described as follows.

DETAILED DESCRIPTION

Figure 1:
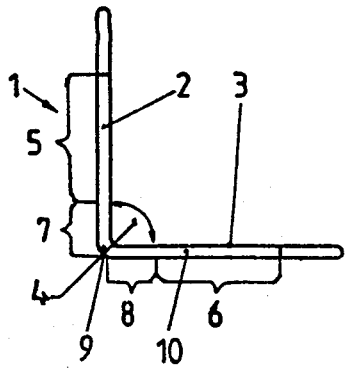
FIG. 1 a cross section of the rail element in its simplest embodiment.
Figure 2:
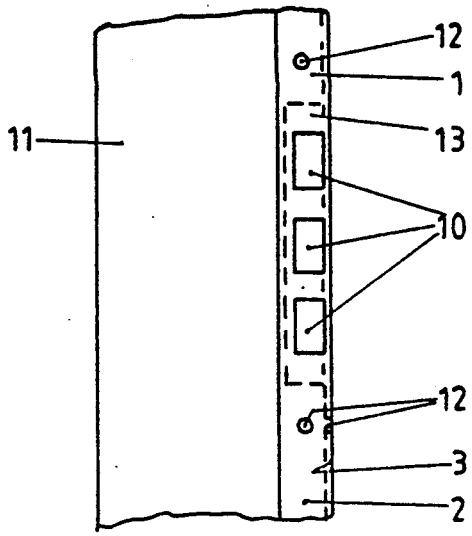
FIG. 2 shows a sideview of the rail element according to FIG. 1 fixed to a board.

The rail element shown in cross section in FIG. 1 includes a profile strip 1 having two legs 2, 3 which define a right angle 4. In each of the legs 2, 3 openings 5, 6 are provided which continue in the adjacent clearances 7, 8 which extend over a common corner 9 of the two legs 2, 3. As a whole, this creates a continuous recess 10 consisting of the openings 5, 6 and the clearances 7, 8. It is important that this recess reaches over the corner 9 with closed edges into the surface areas of the two legs 2, 3. It is clear that the rail element 1 has several recesses 10 provided on top of each other at a distance as shown in FIG. 2. Groups of recesses 10, here a group of three is shown, can be formed. But it is also possible to realize the modular dimension in a continuous manner extending over the entire length of the profile strip 1.

This profile strip 1 is applied to the face of a board 11, e.g. a plywood, in order that one of the legs, e.g. leg 3, covers the face of the board 11, the other leg 2 extending parallel to the board 11. Drilled holes 12 may be provided in one or in both legs 2, 3 for the passage of attachment screws. In order to enable the insertion of hook-formed brackets of article supports into the recesses 10, the board 11 is equipped with a countersinking 13 in the corresponding area. It is not damaging if a bend is provided at a free end on one of the legs 2, 3 (not shown) giving the profile strip 1 as a whole a U-shaped cross section.

Figure 3:
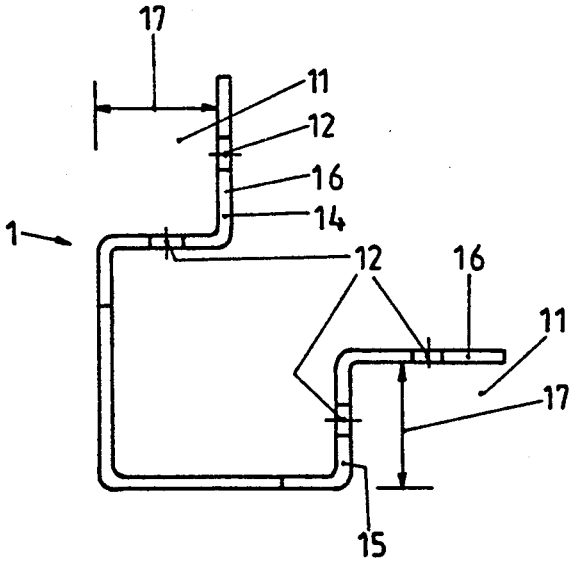
FIG. 3 shows a cross section similar to FIG. 1 in a further embodiment for the formation of an external corner.
Figure 4:
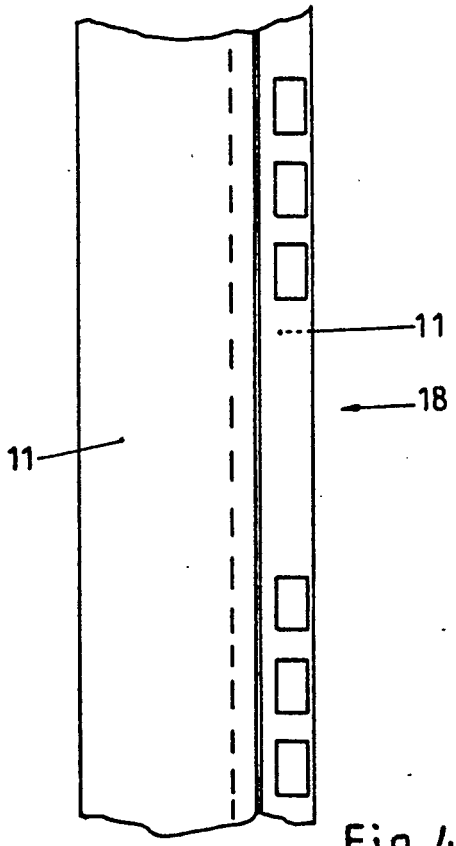
FIG. 4 shows a sideview of the rail element according to FIG. 3 fixed to a board.

FIG. 3 shows another embodiment of the profile strip 1 or the rail element which has been configured as to form an external corner. For this purpose an angular piece 14 is added to the free edge of the leg 2 and an angular piece 15 to the edge of the leg 3 in the represented manner, the part set back 16 of the two angular pieces 14, 15, is provided at a depth 17, which is adjusted to the thickness of a board 11 to be inserted in connection with it. This provides the possibility to use surface-finished boards 11 whose 1 cutting surface do not have to be treated separately, instead it is closed off when the profile strip is applied. In order to fix the boards 11, drilled holes 12 may be provided in the angular pieces 14, 15.

Figure 5:
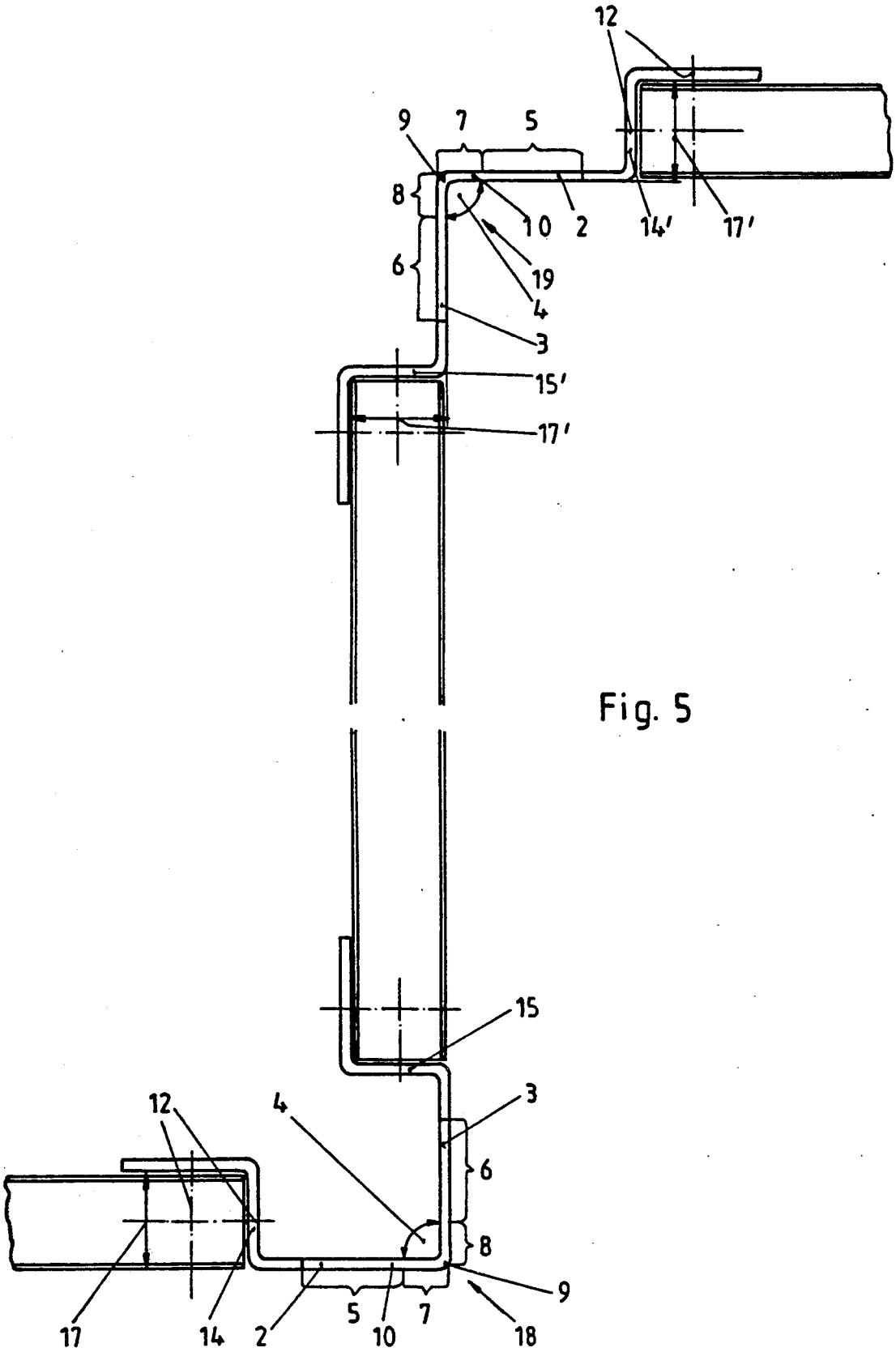
FIG. 5 shows a horizontal section of a bent wall with an external and internal corner.

This enables the formation of an external corner 18 by way of connecting the boards 11. This exterior corner 18 can also be seen in FIG. 5. Additionally, an interior corner 19 is represented, showing that the angular pieces 14' and 15' are arranged as required in this embodiment. The depth 17' has also been kept, of course. In these profile strips which form an interior corner or an exterior corner the openings 5, 6 and the clearances 7, 8 are provided to form continuous recesses 10 as already described in FIG. 1 and FIG. 3.

Figure 6:
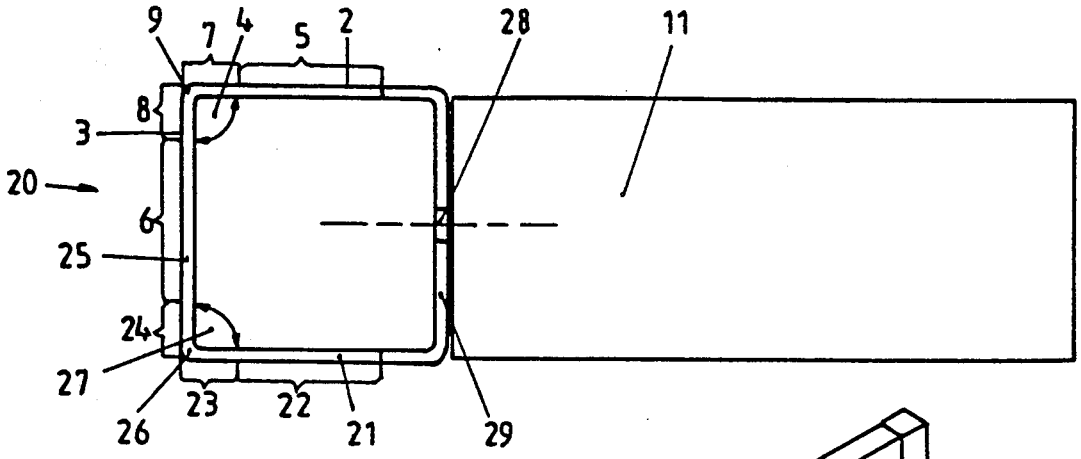
FIG. 6 shows a horizontal section of a further embodiment of the rail element.
Figure 7:
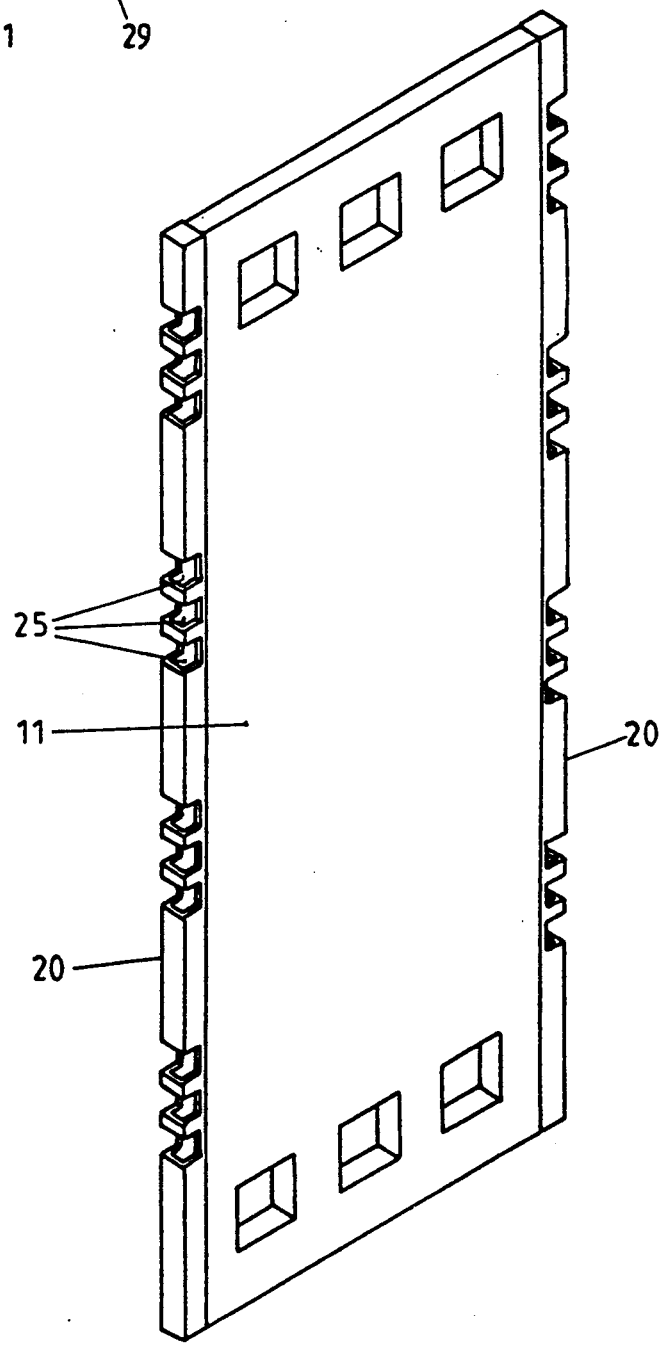
FIG. 7 shows a perspective view of a board wall with rail elements applied to the face sides according to FIG. 6.
Figure 11:
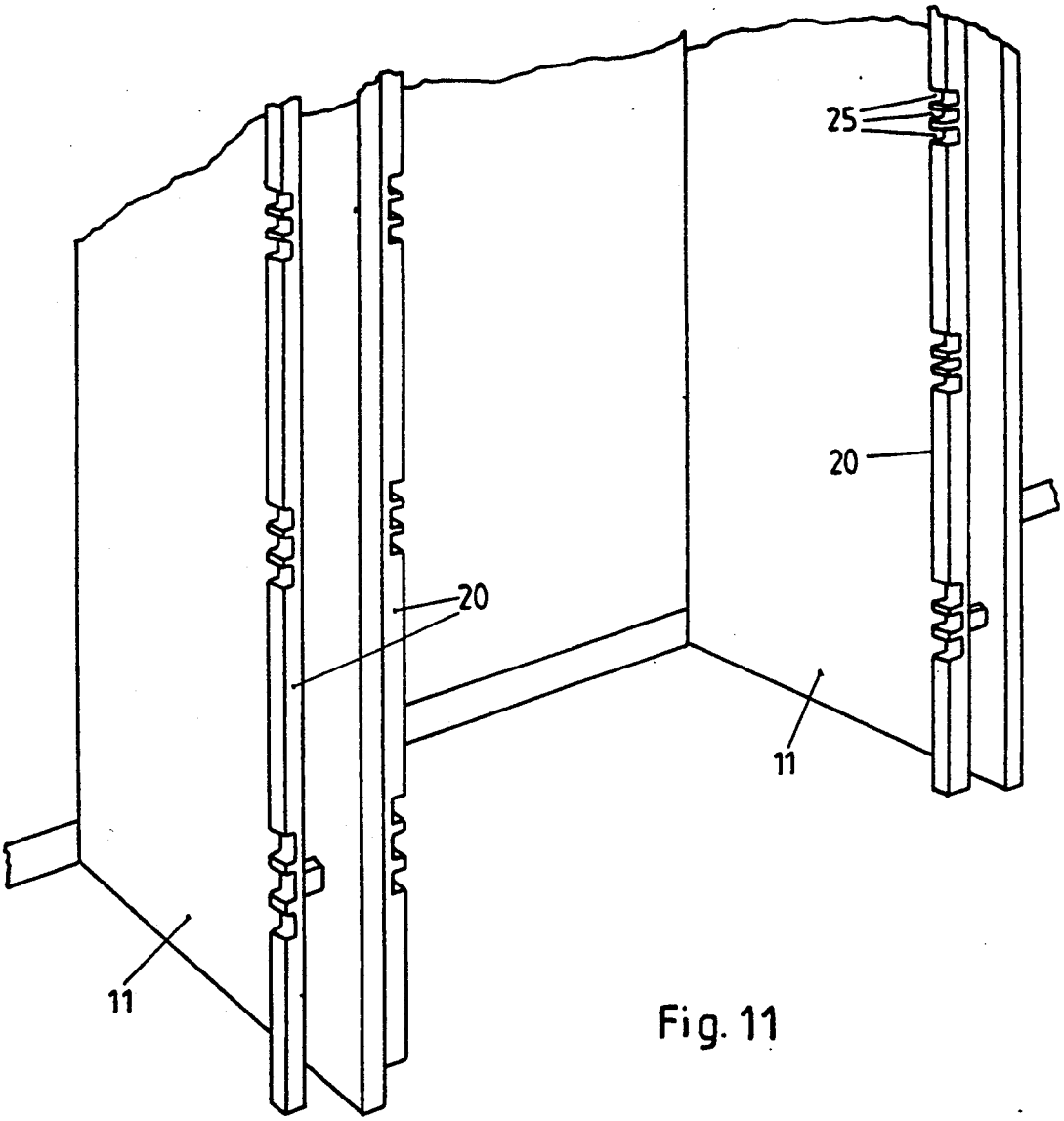
FIG. 11 shows a perspective view of a section with the possible embodiment of the rail element according to FIG. 6 to the surface of a gallery wall.

FIGS. 6 and 7 show a further embodiment of the rail element. Here the recess according to the invention is applied twice. A profile strip 20 with a squared hollow section is provided. Here as well the two legs 2, 3 are realized which define the common angle 4 in the area of the common corner 9. Here the openings 5 and 6, and the clearances 7 and 8 are also realized. To the leg 3 another leg 21 is annexed which again has an opening 22 and a clearance 23. The leg 3 has annexed to its opening 6 another clearance 24 toward the other side thus creating a continuous open space 25 consisting of the openings 5, 6, 22 and the clearances 7, 8, 23, 24 which is formed with closed edges and extends over the planes of the legs 2, 3, 21 in the shown manner. The legs 3, 21 define another right angle 27 at the corner 26. This profile strip 20 can be applied on the face of the board 11 as shown in FIGS. 6 and 7. It is however also possible to arrange this rail element 20 on the side as shown in FIG. 11, arranging several rail elements 20 facing each other. The connection with the board 11 takes place practically through a hole 28 in the backwall 29 of the profile strip 20 through the open space 25.

Figure 8:
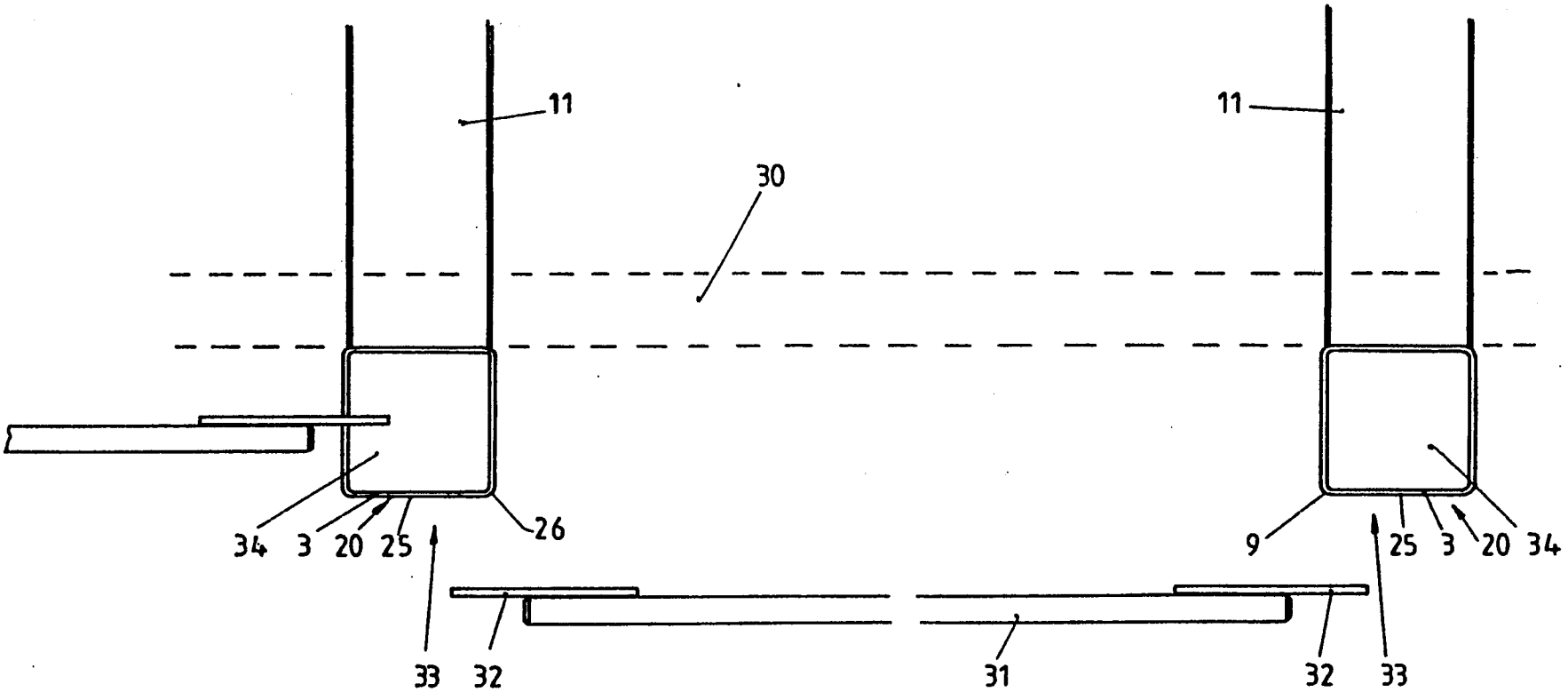
FIG. 8 shows a horizontal section view to represent the intercalation direction of the article support.

FIG. 8 shows a special advantage of the profile strip 20 which is also given analogously by the use of the profile strips 1. The two profile strips 20 are fixed to the faces of the boards 11 which at the same time provide the gallery walls of a shelf or the like to be erected. It is also possible, of course, to fix the profile strips 20 directly to a wall 30 represented by a broken line, e.g. with the conventional dowel assembly method.

An article support 31 is shown carrying on both ends hook-formed brackets 32 formed in the known manner which are to be inserted into the open spaces 25 of the profile strips 20. The translatory intercalation should take place in the direction indicated by the arrows 33 which is the only possibility given here, i.e. with profile strips 20 assembled at a fixed distance. Given that the open spaces 25 extend over the corners 9, 26, it is possible to intercalate the brackets 32 over the breached legs 3 until the brackets 32 are introduced into the enclosed interior space 34 of the profile strip 20. Only then is the article support 31 moved down with the slots provided on the bracket 32 gripping. Note FIG. 9 which points out the special shape of the brackets 32. Finally, installing takes place in the direction indicated by the arrows 35, i.e. in a direction 90° oppositely to the direction of arrows 33. This kind of suspension was not possible in the art until now.

Figure 10:
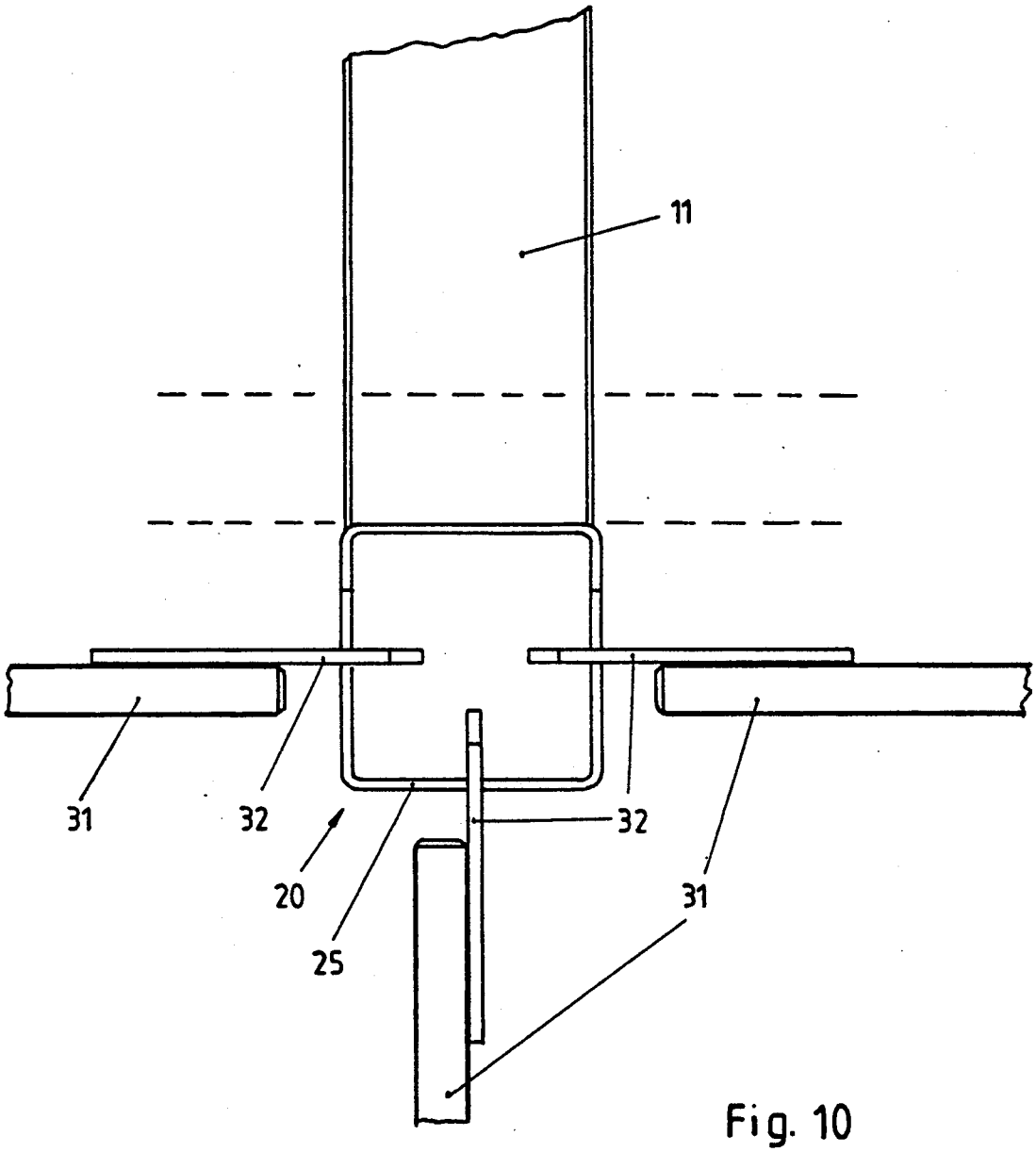
FIG. 10 shows a horizontal section of a rail element functioning as a vertex.

FIG. 10 shows a suspended relative position of three article supports 31 in a profile strip 20 which is fixed to the face of a board 11. It is visible here that three brackets 32 are placed in the continuous open space 25, the corresponding article supports 31 protruding into three different spacial directions.

FIG. 11 shows a possible arrangement in which profile strips 20 are arranged in niches between boards 11 on the sides in such a way that the profile strips 20 are in a relative position facing each other. Here too an article support may be suspended correspondingly with the special advantage that the article support is applied between the walls 11 which are formed as gallery walls.

Figure 12:
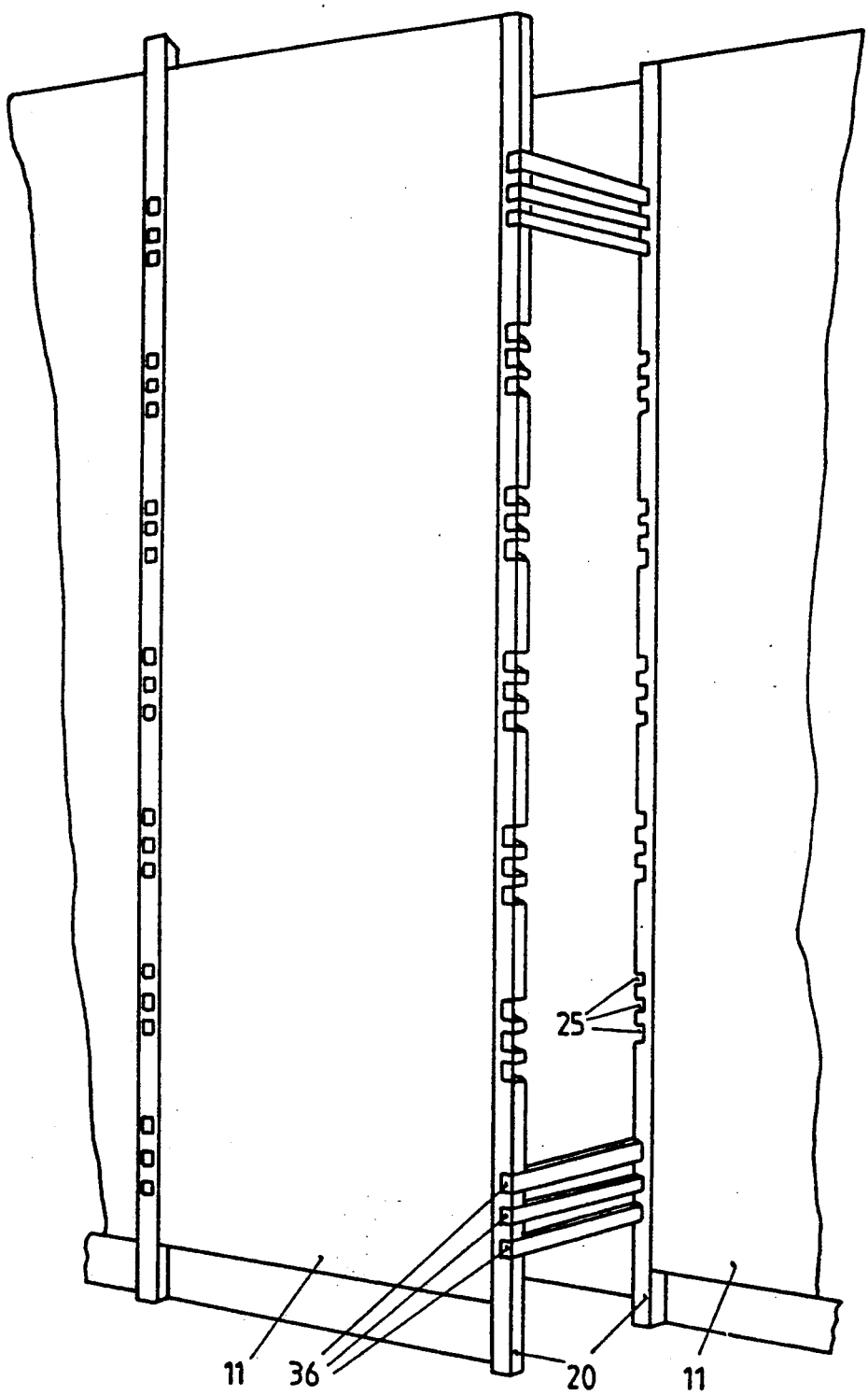
FIG. 12 shows a representation of a spacial embodiment in an angular board connection.

FIG. 12 shows another possible installation and application. Here, an angle formation between two boards 11 or walls is represented. The profile strips 20 are here also fixed to the faces of the boards. Transversal bars 36 are indicated, inserted into the open spaces 25. Article supports of the said kind may be inserted and fastened as well.

Figure 9:
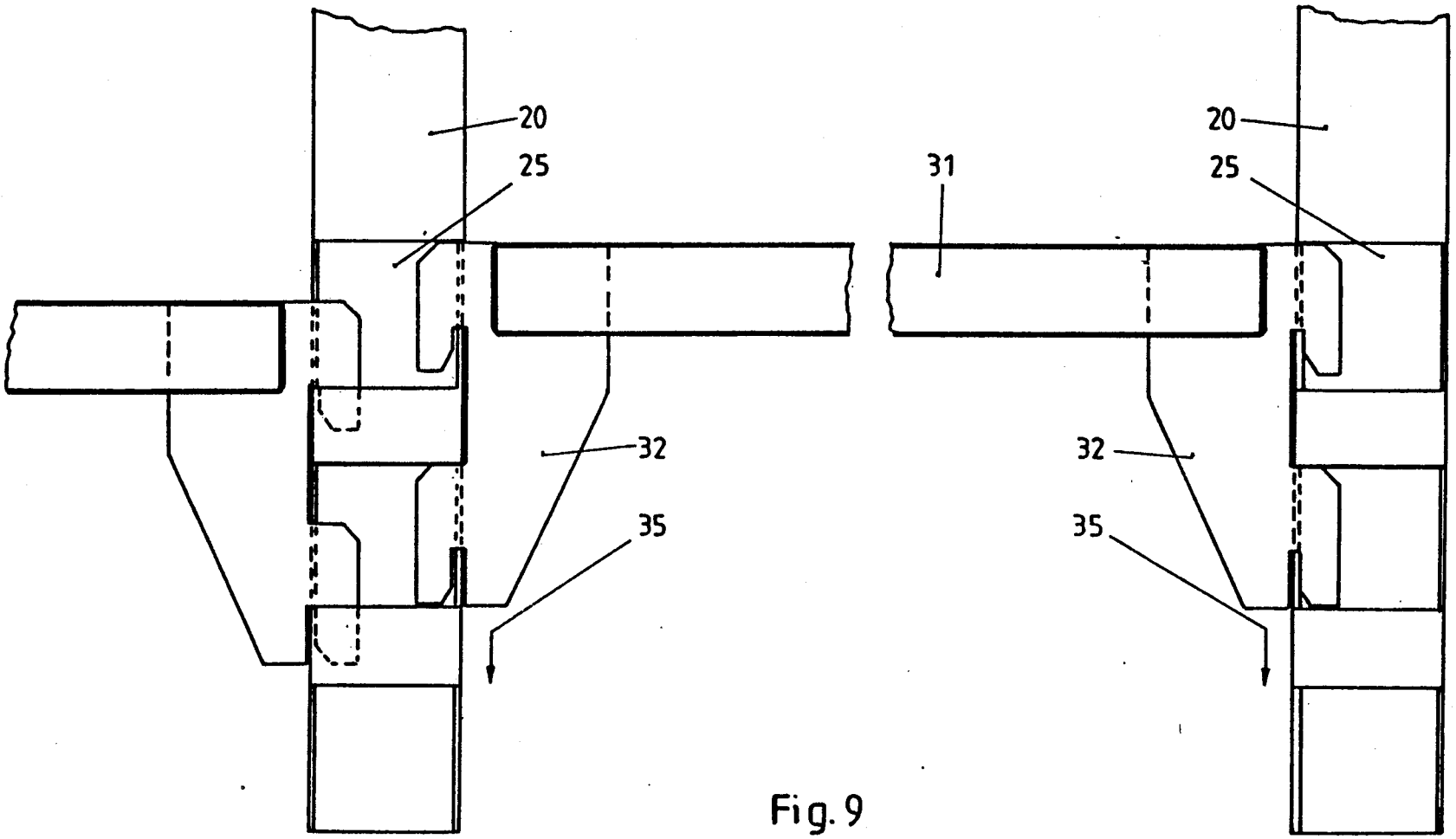
FIG. 9 shows a plan view of the representation according to FIG. 8.
Figure 13:
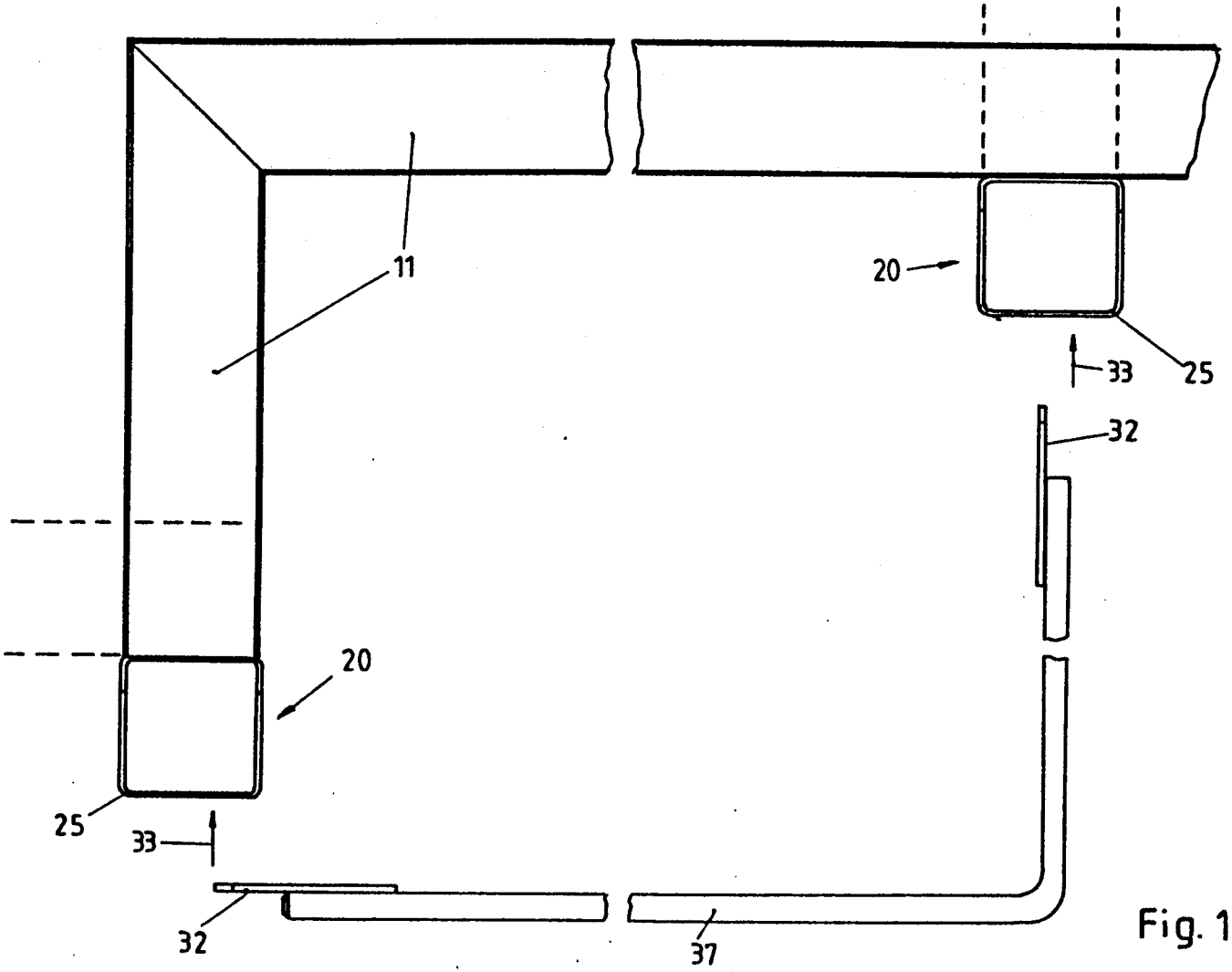
FIG. 13 shows a horizontal view of an angular embodiment.

Finally, FIG. 13 shows a possibility in which two boards 11 are provided in an angular arrangement to each other and the corresponding profile strips 20 according to FIG. 6 are applied in the represented relative position. The two brackets 32 of an article support 37 in angular formation is inserted into the open spaces 25 in the direction indicated by arrow 33 and lowered, the brackets 32 gripping with their slots as shown in FIG. 9 for another application possibility.

List of Reference Numbers:

1=profile strip
37=article support
2=leg
3=leg
4=angle
5=opening
6=opening
7=clearance
8=clearance
9=edge
10=recess
11=board
12=drilled hole
13=countersinking
14=angular piece
15=angular piece
16=part
17=depth
18=exterior corner
19=interior corner
20=profile strip
21=leg
22=opening
23=clearance
24=clearance
25=open space
26=edge
27=angle
28=drilled hole
29=backwall
30=wall
31=article support
32=bracket
33=arrow
34=interior space
35=arrow
36=transversal bar

We claim:

1. In a rail element of the type used for the reception of article supports with said rail element including a metallic elongated profile strip having a cross section with at least two legs oriented at a right angle with respect to each other, one of the legs having openings into which hook-formed brackets of article supports can be inserted, the openings being provided at an equal distance from each other in the main direction of extension of the rail element in a vertically aligned manner allowing a height-adjustable arrangement of the article support, the improvement therein comprising the other leg (3) being provided with openings as well which are arranged at the same height as the openings (5) in the first leg (2), the two openings (5, 6) in each leg corresponding to each other being connected with a clearance (7, 8) forming a continuous opening (10) which extends over the right angle.

2. A rail element in accordance with claim 1, wherein the common contours of the opening (5, 6) and the connecting clearance (7, 8) in one of the legs is formed bigger than the contours of the insertable part of the hook-formed bracket (32).

3. A rail element in accordance with claim 1, wherein the openings (5, 6) and the connecting clearance (7, 8) are arranged on a leg (2 or 3) by the formation of connecting bridges between the openings and a wall part extending in the main direction of extension of the rail element.

4. A rail element in accordance with claim 3, wherein the ratio of the edge-length of the opening (5) including the clearance (7) in one leg (2) perpendicular to the main direction of extension to the height of the connecting bridges located between the openings to the width of the wall parts is approximately 3:2:1.

5. A rail element in accordance with claim 1, wherein the rail element has a tubular squared cross section and the openings (5, 6, 22) and the clearances (7, 8, 23, 24) are located in three of the legs (2, 3, 21) forming a continuous open space (25) extending over the three legs (2, 3, 21).

6. A rail element in accordance with claim 1 and further comprising angular profiles (14, 15; 14', 15') annexed to the two legs (2, 3, 21) oriented at a right angle (4 or 26) to form an external corner (18) or an internal corner (19) which define a plane surface set back from the surface of the corresponding leg, and the measurement of the space of the set back being approximately equal to the thickness of a surface-finished board (11).

7. A rail element for the reception of article supports comprising:

an elongated metallic profile strip having a cross section with at least two legs oriented at a right angle with respect to each other, each of said legs having a plurality of openings spaced along its length into which hook-formed brackets of article supports can be inserted, the plurality of openings of each leg being provided in an aligned manner along the longitudinal direction of extension of the rail element, the openings of each leg being aligned at the same height as the corresponding openings of the other leg with the corresponding aligned openings being contiguous so as to form a continuous opening extending about the right angle, so that an article can be supported adjacent either of the two legs of the profile strip.

8. A rail element in accordance with claim 7, wherein the breadth of each opening is greater than the insertable part of the hook-formed bracket which is to be inserted into each opening.

9. A rail element in accordance with claim 7, wherein the continuous openings are arranged on a leg by the formation of connecting bridges between the openings and a wall part extending in the longitudinal direction of extension of the rail element.

10. A rail element in accordance with claim 9, wherein the ratio of the edge length of an opening in one leg perpendicular to the longitudinal direction of extension to the height of the connecting bridges located between the openings to the width of the wall parts is approximately 3:2:1.

11. A rail element in accordance with claim 7, wherein the rail element has a tubular squared cross section and openings are located in three legs of the cross section and form a continuous opening extending over the two right angles formed by the three legs.

12. A rail element in accordance with claim 7, wherein angular profiles are annexed to the two legs oriented at a right angle to form an external corner which defines a plane surface set back from the surface of the corresponding leg, the measurement between the set back plane surface and the surface of the corresponding leg being approximately equal to the thickness of a surface finished board adapted for mounting to the angular profiles forming the angular profiles.

13. A rail element in accordance with claim 7, wherein angular profiles are annexed to the two legs oriented at a right angle to form an internal corner which defines a set back plane surface set back from the surface of the corresponding leg, the measurement between the set back plane surface and the surface of the corresponding leg being approximately equal to the thickness of a surface finished board adapted for mounting to the angular profiles forming the angular profiles.

* * * * *